US008653967B1

(12) United States Patent
Vosburgh

(10) Patent No.: US 8,653,967 B1
(45) Date of Patent: Feb. 18, 2014

(54) COMMUNICATIONS BUOYS, METHODS AND COMPUTER PROGRAM PRODUCTS FOR SELECTIVELY TRANSMITTING COMMUNICATION SIGNALS

(75) Inventor: Frederick Vosburgh, Durham, NC (US)

(73) Assignee: iRobot Corporation, Bedford, MA (US)

( * ) Notice: Subject to any disclaimer, the term of this patent is extended or adjusted under 35 U.S.C. 154(b) by 1057 days.

(21) Appl. No.: 12/617,103

(22) Filed: Nov. 12, 2009

Related U.S. Application Data

(60) Provisional application No. 61/114,232, filed on Nov. 13, 2008.

(51) Int. Cl.
*G08B 1/08* (2006.01)

(52) U.S. Cl.
USPC ..... 340/539.26; 340/539.1; 340/539.11; 340/539.13; 340/506; 340/3.1

(58) Field of Classification Search
USPC ..... 340/539.26, 539.1, 539.11, 539.13
See application file for complete search history.

(56) References Cited

U.S. PATENT DOCUMENTS

| | | | | |
|---|---|---|---|---|
| 4,189,786 | A | 2/1980 | Adler | |
| 6,058,071 | A | 5/2000 | Woodall et al. | |
| 6,254,445 | B1 | 7/2001 | Jones | |
| 6,711,095 | B1 | 3/2004 | Daniels | |
| 6,738,314 | B1 | 5/2004 | Teeter et al. | |
| 6,813,218 | B1 | 11/2004 | Antonelli et al. | |
| 6,899,583 | B2 | 5/2005 | Barden | |
| 6,961,657 | B1 | 11/2005 | Wernli et al. | |
| 7,496,000 | B2 | 2/2009 | Vosburgh et al. | |
| 7,496,002 | B2 | 2/2009 | Vosburgh | |
| 2006/0050610 | A1* | 3/2006 | Harvey et al. | 367/5 |
| 2006/0195263 | A1* | 8/2006 | Meinig et al. | 702/3 |
| 2008/0117040 | A1* | 5/2008 | Peel et al. | 340/539.16 |
| 2008/0192576 | A1 | 8/2008 | Vosburgh et al. | |
| 2008/0223278 | A1* | 9/2008 | Carro et al. | 114/264 |

* cited by examiner

*Primary Examiner* — Daryl Pope
(74) *Attorney, Agent, or Firm* — Myers Bigel Sibley & Sajovec, PA

(57) ABSTRACT

A method for selectively transmitting communication signals from a communications buoy to a remote receiver, the communications buoy including a sensor and an emitter device, includes: detecting conditions local to the communications buoy using the sensor; generating local conditions data corresponding to the local conditions detected by the sensor; using the local conditions data, determining and/or predicting a clear transmission time during which communication signals from the emitter device have an adequately clear transmission path to the remote receiver for successful transmission of communication signals from the emitter device to the remote receiver; and adaptively transmitting communication signals from the emitter device to the remote receiver as a function of the determined and/or predicted clear transmission time.

18 Claims, 6 Drawing Sheets

COMMUNICATIONS BUOYS, METHODS AND COMPUTER PROGRAM PRODUCTS FOR SELECTIVELY TRANSMITTING COMMUNICATION SIGNALS

RELATED APPLICATION(S)

This application claims the benefit of and priority from U.S. Provisional Patent Application No. 61/114,232, filed Nov. 13, 2008, the disclosure of which is incorporated herein by reference.

STATEMENT OF GOVERNMENT SUPPORT

This invention was made with support under Small Business Innovation Research (SBIR) Program No. N00014-07-C-0197 awarded by the United States Navy Office of Naval Research. The Government has certain rights in the invention.

FIELD OF THE INVENTION

The present invention relates to communications devices and, more particularly, to communications buoys capable of wirelessly communicating with a remote receiver.

BACKGROUND OF THE INVENTION

Monitoring littoral seas without being detected can be desirable in times of conflict. In such cases, autonomous submersible monitoring and communications systems can provide much needed intelligence. While such devices can be deployed without detection, communicating the results of monitoring by devices submerged in the sea is problematic. Sonar provides low bandwidth over short ranges and radio communications, at all but the highest powers and lowest data rates, are blocked by salt water.

SUMMARY OF THE INVENTION

According to embodiments of the present invention, a method for selectively transmitting communication signals from a communications buoy to a remote receiver, the communications buoy including a sensor and an emitter device, includes: detecting conditions local to the communications buoy using the sensor; generating local conditions data corresponding to the local conditions detected by the sensor; using the local conditions data, determining and/or predicting a clear transmission time during which communication signals from the emitter device have an adequately clear transmission path to the remote receiver for successful transmission of communication signals from the emitter device to the remote receiver; and adaptively transmitting communication signals from the emitter device to the remote receiver as a function of the determined and/or predicted clear transmission time.

According to some embodiments, the communications buoy is a floating aquatic communications buoy including a radio transmitter, the emitter device is a radio antenna, and the method includes generating radio signals from the radio transmitter to the remote receiver during one or more clear transmission times while the communications buoy is floating on a body of water.

Generating the local conditions data may include deriving the local conditions data from sensor signals generated by the sensor, the sensor signals corresponding to the conditions local to the emitter device. In some embodiments, the sensor signals are reflective of the location of the communications buoy with respect to water waves between the communications buoy and the remote receiver.

According to some embodiments, determining and/or predicting the clear transmission time includes predicting one or more future clear transmission times using the local conditions data. Predicting one or more future clear transmission times can include programmatically analyzing the local conditions data using a predictive filter. In some embodiments, predicting one or more future clear transmission times includes predicting the one or more future clear transmission times using at least one sensor signal representative of: an acceleration of the communications buoy; a velocity of the communications buoy; a position of the communications buoy; a tilt of the communications buoy; a directional orientation of the communications buoy; and intensity of signals received by the communications buoy. Predicting one or more future clear transmission times may include estimating a position of the communications buoy relative to the height of at least one aquatic wave with respect to a transmission path from the communications buoy to the remote receiver.

In some embodiments, determining and/or predicting the clear transmission time includes generating a statistical representation of one or more sea state attributes of a body of water upon which the communications buoy is floating.

According to some embodiments, generating local conditions data corresponding to the local conditions detected by the sensor includes generating position data corresponding to an elevation of the communications buoy and/or an orientation of the communications buoy with respect to the horizon, determining and/or predicting the clear transmission time includes using the position data to predict when the emitter device will be desirably positioned and/or oriented with respect to the remote receiver, and adaptively transmitting communication signals from the emitter device to the remote receiver includes determining when to generate signals from the emitter device to the remote receiver based on the prediction.

Determining and/or predicting the clear transmission time may include comparing the local conditions data to a threshold.

In some embodiments, the local conditions data corresponds to an intensity of light incident upon the emitter device.

Detecting conditions local to the communications buoy using the sensor can include imaging surrounding aquatic waves using a camera forming a part of the communications buoy.

In some embodiments, adaptively transmitting communication signals includes selectively controlling the start and termination of transmission of the communications signals from the emitter device to the remote receiver as a function of the determined and/or predicted clear transmission time.

Adaptively transmitting communication signals may include selectively controlling a transmission power level of the communications signals transmitted from the emitter device to the remote receiver as a function of the determined and/or predicted clear transmission time.

Adaptively transmitting communication signals may include selectively controlling a data transmission rate of the communications signals transmitted from the emitter device to the remote receiver as a function of the determined and/or predicted clear transmission time.

In some embodiments, adaptively transmitting communication signals includes actively orienting the emitting device to selectively control a compass direction of transmission of the communication signals as a function of the determined and/or predicted clear transmission time.

According to some embodiments, adaptively transmitting communication signals includes segmenting a message into a plurality of message segments and transmitting the respective message segments at temporally spaced apart times determined and/or predicted by the communications buoy to be clear transmission times.

According to embodiments of the present invention, a communications buoy for selectively transmitting communication signals to a remote receiver includes an emitter device to transmit communication signals to the remote receiver, a sensor to detect conditions local to the communications buoy using the sensor, and a controller. The controller is configured to: generate local conditions data corresponding to the local conditions detected by the sensor; determine and/or predict, using the local conditions data, a clear transmission time during which communication signals from the emitter device have an adequately clear transmission path to the remote receiver for successful transmission of communication signals from the emitter device to the remote receiver; and adaptively transmit communication signals from the emitter device to the remote receiver as a function of the determined and/or predicted clear transmission time.

According to embodiments of the present invention, a computer program product for selectively transmitting communication signals from a communications buoy to a remote receiver, the communications buoy including an emitter device to transmit communication signals to the remote receiver and a sensor to detect conditions local to the communications buoy, comprises a computer readable medium having computer usable program code embodied therein. The computer usable program code comprises: computer readable program code configured to generate local conditions data corresponding to the local conditions detected by the sensor; computer readable program code configured to determine and/or predict, using the local conditions data, a clear transmission time during which communication signals from the emitter device have an adequately clear transmission path to the remote receiver for successful transmission of communication signals from the emitter device to the remote receiver; and computer readable program code configured to adaptively transmit communication signals from the emitter device to the remote receiver as a function of the determined and/or predicted clear transmission time.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
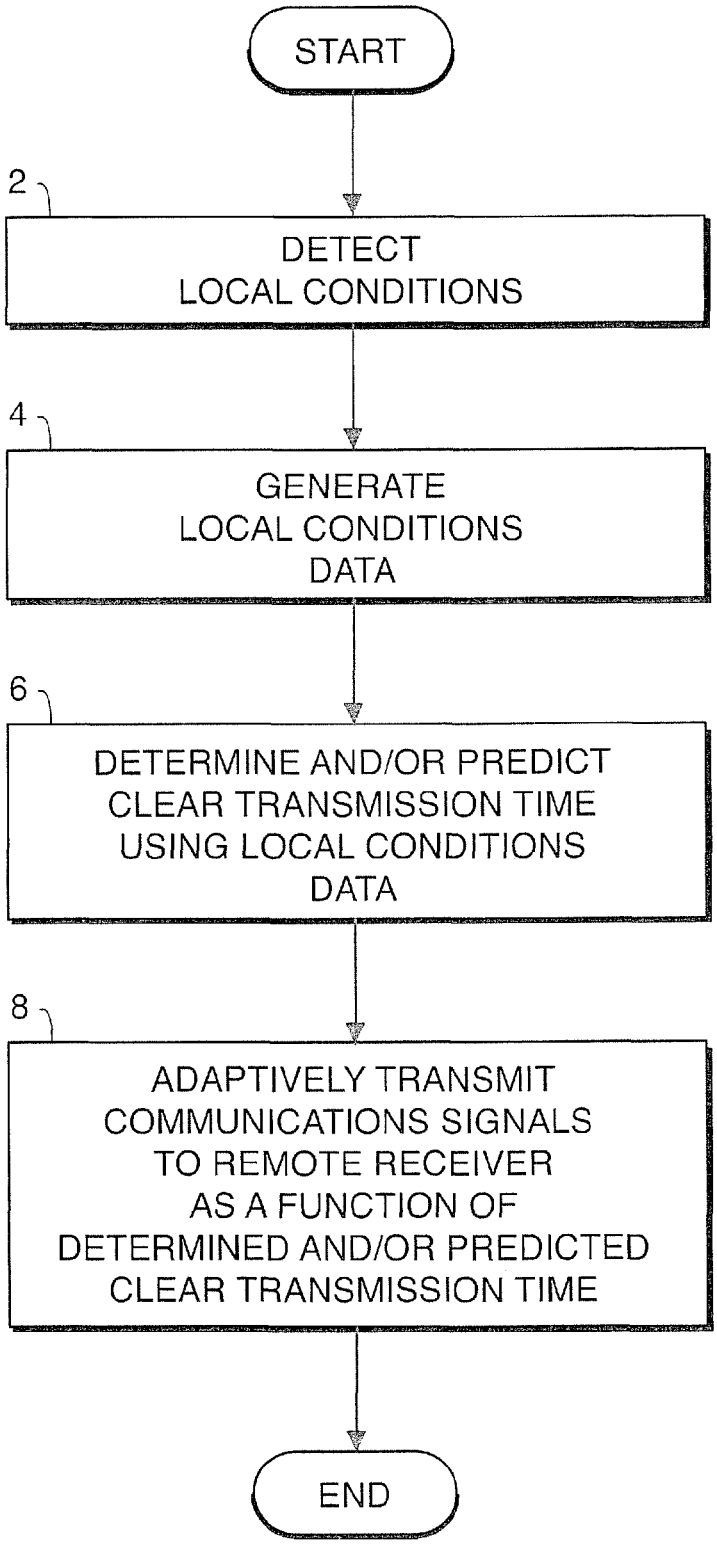
FIG. 1 is a flow chart illustrating methods and/or operations according to embodiments of the present invention for selectively transmitting communication signals.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described below with reference to block diagrams and/or flowchart illustrations of methods, apparatus (systems and/or devices) and/or computer program products. It is understood that a block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means (functionality) and/or structure for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the functions/acts specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, exemplary embodiments may be implemented in hardware and/or in software (including firmware, resident software, micro-code, etc.). Furthermore, exemplary embodiments may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Computer program code for carrying out operations of data processing systems discussed herein may be written in a high-level programming language, such as Java, AJAX (Asynchronous JavaScript), C, and/or C++, for development convenience. In addition, computer program code for carrying out operations of exemplary embodiments may also be written in other programming languages, such as, but not limited to, interpreted languages. Some modules or routines may be written in assembly language or even micro-code to enhance performance and/or memory usage. However, embodiments are not limited to a particular programming language. It will be further appreciated that the functionality of any or all of the program modules may also be implemented using discrete hardware components, one or more application specific integrated circuits (ASICs), or a programmed digital signal processor or microcontroller.

The flowcharts and block diagrams of certain of the figures herein illustrate exemplary architecture, functionality, and operation of possible implementations of embodiments of the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently.

The term "programmatically" refers to operations directed and/or primarily carried out electronically by computer program modules, code and instructions.

According to embodiments of the invention, deployable devices, systems for their deployment, and methods of using the devices and systems are provided. The devices may be referred to hereinafter as "communications buoys", "communications devices" or "data bubbles."

The advent of affordable miniaturized radios that can transmit long distances has fostered a new generation of small expendable buoys for data gathering and communications, such as the Data Bubble devices offered by iRobot Maritime Systems of Durham, N.C. Radio transmissions by such buoys can, however, be interrupted by waves, either by small or breaking waves that splash water over the buoy ("over-washing") or by larger waves that rise up between the buoy and a remote receiver unit, blocking the transmission without engulfing the buoy. Expendable small buoys can be designed to minimize over-washing by using high buoyancy (i.e., having a large displacement volume relative to buoy mass). Typically, high buoyancy is achieved by reducing the weight of the batteries. The resulting mitigation of over-washing may come, however, at the price of less energy for communications.

As low cost devices, expendable communications buoys typically use transmit-only radios and antennas. Unable to receive an acknowledgement, these radios typically are configured to transmit repeatedly until the battery is exhausted. In rough seas, where high waves are more likely to rise up and interrupt transmission, reducing battery mass reduces the number of repetitions possible, in turn making reliable communication less assured.

In addition, expendable buoys at times are programmed to transmit at very low power (e.g., to minimize chances of detection by adversaries). With data rate being a function of transmit power, reducing transmit power translates into a longer duration to send a given message. And, the longer the transmit duration, the greater the chance in rough water that a wave will rise up in the signal path and block the signal.

In view of the foregoing, methods and apparatus according to embodiments of the present invention control transmission by communications devices such as water-borne buoys so that the signals are emitted from the communications device at times when the transmission path from the communications device to a remote receiver unit is predictably clear of signal-blocking obstructions, thereby enhancing the probability of successful transmission in an energy efficient manner. The method can include sensing local conditions (i.e., conditions local to the communications device), predicting the occurrence of one or more clear path times, estimating local conditions and transmitting at a desirable predicted time. The method can also include estimating the local conditions using the sensed conditions. The method may include predicting a desirable time for signal transmission, a time of substantially clear signal path, and/or a time when an antenna pattern of the communications device is desirably oriented. The method may further include adapting signal transmission from the communications device to local conditions, such as by adjusting the time and/or duration of transmission with respect to a sea state, adjusting the transmission power according to sea state, adjusting a transmission data rate according to sea state, and/or adjusting transmission with respect to a wave proximate the communications device.

Referring now to FIG. 1, a flow chart illustrating operations of the present invention for selectively transmitting communication signals from a communications buoy to a remote receiver will now be described. The operations include detecting conditions local to the communications buoy using a sensor of the communications buoy (Block 2). Local conditions data is generated corresponding to the local conditions detected by the sensor (Block 4). Using the local conditions data, a clear transmission time is determined and/or predicted during which communication signals from an emitter device of the communications buoy have an adequately clear transmission path to the remote receiver for successful transmission of communication signals from the emitter device to the remote receiver (Block 6). Communication signals are then adaptively transmitted from the emitter device to the remote receiver as a function of the determined and/or predicted clear transmission time (Block 8). In some embodiments, the communications buoy is a floating aquatic communications buoy including a radio transmitter, the emitter device is a radio antenna, and radio signals are generated from the radio transmitter to the remote receiver during one or more clear transmission times while the communications buoy is floating on a body of water.

Figure 2:
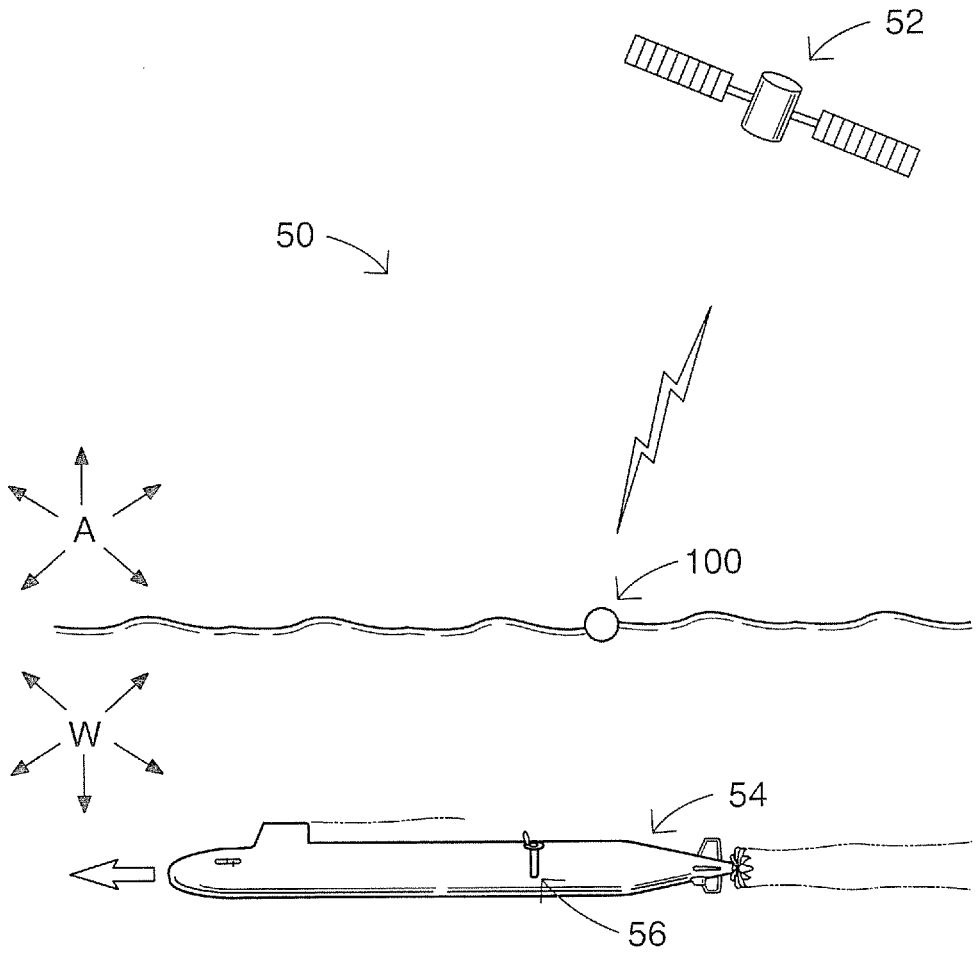
FIG. 2 is a schematic view of a communications system according to embodiments of the present invention.

With reference to FIG. 2, a communications system 10 according to embodiments of the present invention is shown therein in a body of water W and in the air A above the water W. As illustrated, the system 10 includes a remote station or receiver unit 52 such as a satellite, a deployment vehicle 54 such as a submarine, and a communications device or unit 100 according to embodiments of the present invention. According to some embodiments and as discussed hereinafter, the communications device 100 is a water submersible aquatic communications buoy. The buoy 100 is adapted or configured for carrying out the foregoing methods. More particularly, the buoy 100 is adapted or configured to communicate by sending signals to (and, optionally, receiving signals from) a remote device (e.g., the remote station 52) from a location proximate or on the surface of the water W. Systems and methods of the present invention may be used for communications between a submerged object or location and a remote user. In some cases, the buoy 100 is also configured as a sensing device for environmental, oceanographic, intelligence, surveillance, or reconnaissance uses, which sensing is conducted in air A or water W. The system 10 is merely exemplary of systems in accordance with the present invention, and various modifications may be made. The system 10 may include a plurality of the buoys 100.

Figure 3:
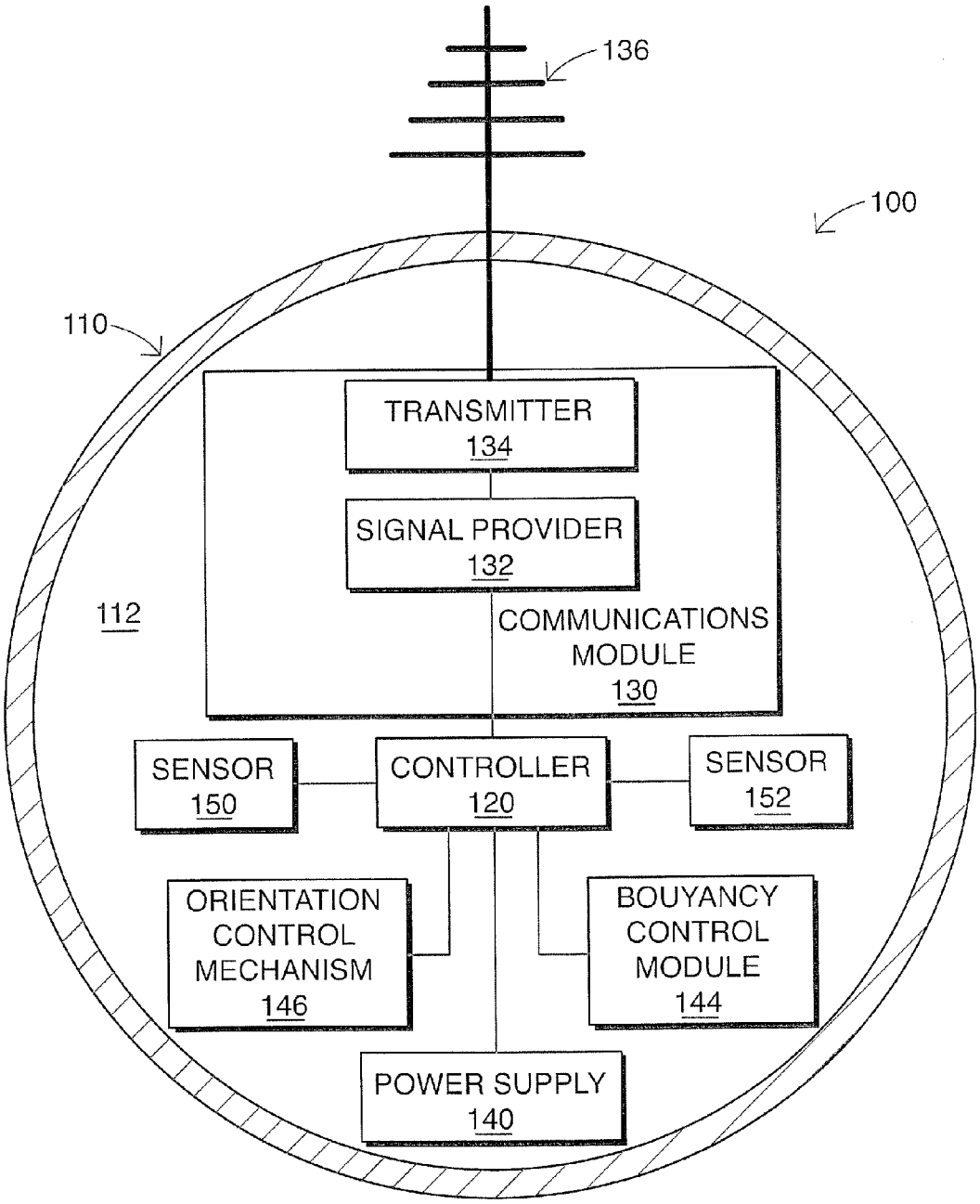
FIG. 3 is a schematic, cross-sectional view of a communications buoy according to embodiments of the present invention and forming a part of the communications system of FIG. 2.
Figure 4:
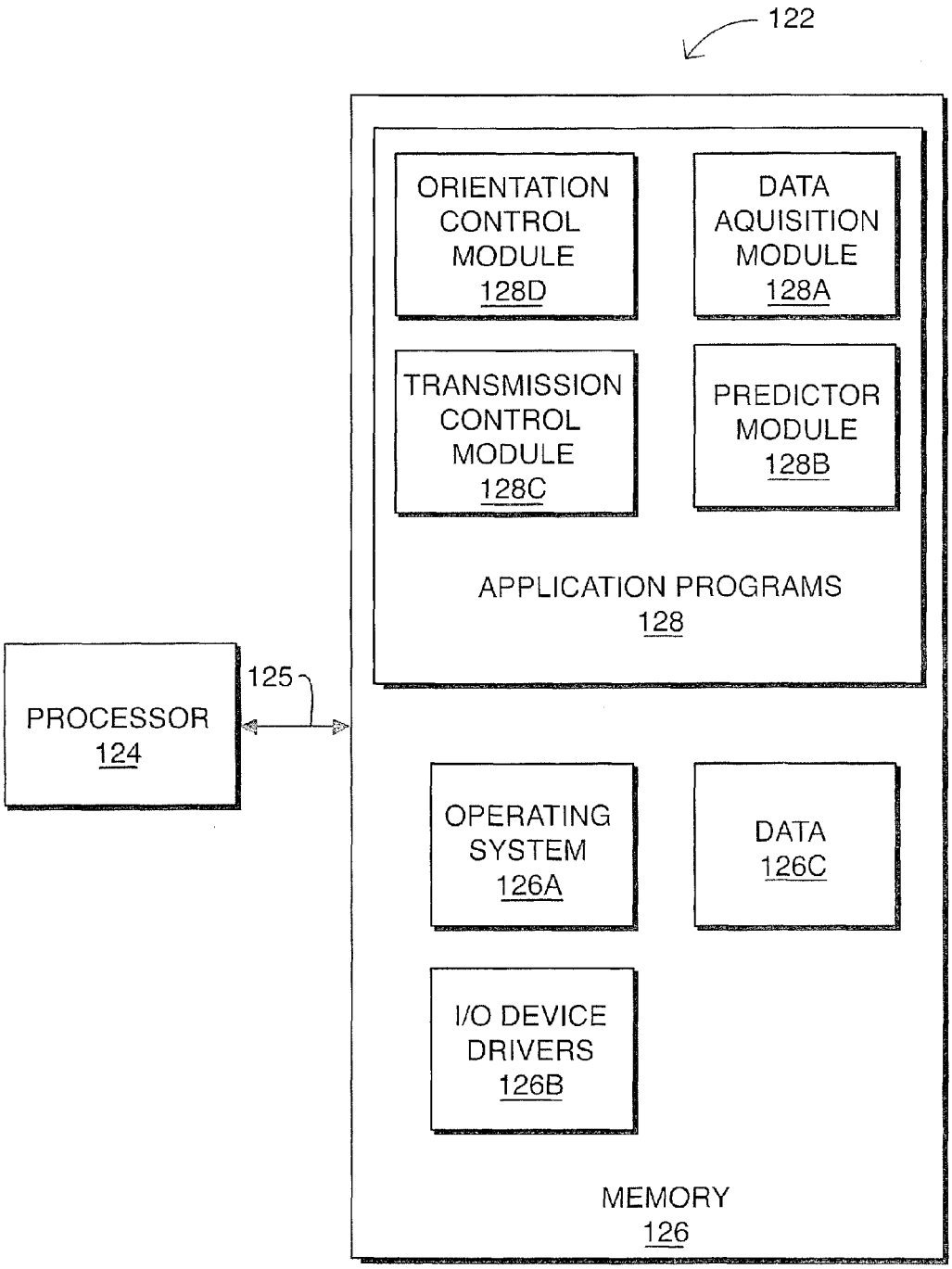
FIG. 4 is a schematic diagram of a data processing system of the communications buoy of FIG. 3.

The buoy 100 is shown in further detail in FIGS. 3 and 4. With reference to FIG. 3, the buoy 100 includes a housing 110, a controller 120, a communications module 130, a power supply 140, a buoyancy control module 144, an orientation control mechanism 146, an operational sensor 150, and a local conditions sensor 152.

The housing 110 defines an interior chamber 112. According to some embodiments, some or all of the foregoing electronic components (e.g., the controller 120, the communications module 130, the power supply 140, and the orientation control mechanism 146) are substantially fully contained in the chamber 120. According to some embodiments, the housing 110 is water submersible such that water is prevented from contacting the communications module 130 (or water sensitive components thereof) during all intended underwater operating conditions.

According to some embodiments, the housing 110 is spherical as shown. However, other shapes may be employed (e.g., cylindrical, prismatic, conical, spherical faceted, or other geometric shapes including a volume enveloped by three or more planar and/or curvi-planar surfaces). According to some embodiments, the housing 100 is formed of a substantially rigid material and/or is constructed so as to remain in a single rigid configuration. Suitable rigid materials for forming the housing 110 may include a polymeric material. According to other embodiments, the housing 110 is formed of a flexible material so that the housing 110 is volumetrically expandable as discussed below.

According to some embodiments, the housing 110 has a total volume in the range of between about 0.1 and 10 cubic meters. According to some embodiments, the housing 110 is a sphere having a diameter of between about 3 and 30 cm.

In some cases, the buoy 100 has a high buoyancy in water. In some embodiments, the buoy 100 has an overall buoyancy such that in calm sea conditions the buoyancy supports at least 20% of the buoy volume above the surface of the water. The buoy 100 may have a low over-wash design provided by high buoyancy.

According to some embodiments, the housing 110 is shaped and constructed for deployment from a launching device. For example, the housing 110 may be adapted and configured to be effectively ejected from an ejector 56 (FIG. 1) of the submarine 54. Additionally or alternatively, the housing 110 may be adapted and configured to be stored in a container that is ejected from a launching or other deploying device, in which case the buoy 100 may separate from the container following ejection.

The controller 120 is configured to control operation of a transmitter 134 of the communications module 130 and may also be configured to execute signal processing. In some cases, the controller 120 is configured to produce a statistical representation of sea state or other local conditions.

The controller 120 can include circuits or modules that can comprise computer program code used to carry out operations to assess and evaluate local conditions and control emission of communications signals from the buoy 100. FIG. 4 is a schematic illustration of a circuit or data processing system 122 that can be used for the controller 120. The circuits and/or data processing system 122 may be incorporated in a digital signal processor in any suitable device or devices. As shown in FIG. 4, the processor 124 communicates with memory 126 via an address/data bus 125. The processor 124 can be any commercially available or custom microprocessor. The memory 126 is representative of the overall hierarchy of memory devices containing the software and data used to implement the functionality of the data processing system. The memory 126 can include, but is not limited to, the following types of devices: cache, ROM, PROM, EPROM, EEPROM, flash memory, SRAM, and DRAM.

FIG. 4 illustrates that the memory 126 may include several categories of software and data used in the data processing system: the operating system 126A; the application programs 128; the input/output (I/O) device drivers 126B; and data 126C. The data 126C can also include local conditions threshold values and sea state representations.

As will be appreciated by those of skill in the art, the operating system 126A may be any operating system suitable for use with a data processing system, such as OS/2, AIX, DOS, OS/390 or System390 from International Business Machines Corporation, Armonk, N.Y., Windows CE, Windows NT, Windows95, Windows98, Windows2000 or other Windows versions from Microsoft Corporation, Redmond, Wash., Unix or Linux or FreeBSD, Palm OS from Palm, Inc., Mac OS from Apple Computer, LabView, or proprietary operating systems. The I/O device drivers 126B typically include software routines accessed through the operating system 126A by the application programs 128 to communicate with devices such as I/O data port(s), data storage and certain memory components. The application programs 128 are illustrative of the programs that implement the various features of the data processing system and can include at least one application, which supports operations according to embodiments of the present invention. Finally, the data 126C represents the static and dynamic data used by the application programs 128, the operating system 126A, the I/O device drivers 126B, and other software programs that may reside in the memory 126.

The application programs include a data acquisition module 128A, a predictor module 128B, a transmission control module 128C, and an orientation control module 128D. The use and operation of these modules will be discussed in more detail hereinbelow.

While the present invention is illustrated, for example, with reference to the modules 128A-D being an application program or programs in FIG. 4, as will be appreciated by those of skill in the art, other configurations may also be utilized while still benefiting from the teachings of the present invention. For example, one or more of the modules 128A-D may also be incorporated into the operating system, the I/O device drivers or other such logical division of the data processing system. Thus, the present invention should not be construed as limited to the configuration of FIG. 4 which is intended to encompass any configuration capable of carrying out the operations described herein. Further, one or more of the modules can communicate with or be incorporated totally or partially in other components, such as the communications module 130 or a sensor 150, 152.

For the purpose of illustration, the controller 120 is illustrated as a module; however, it will be appreciated that the controller 120 and functionality thereof may be distributed over two or more different devices or modules. For example, the sensor 152 may include or have associated therewith a circuit or data processing system that generates local conditions data as described herein from the sensor signals of the sensor 152.

By way of example, the controller 120 may be based on or configured on the Diopsis microchip sold by Atmel Corporation of San Jose, Calif.

With further reference to FIG. 3, the communications module 130 includes a signal provider 132, the transmitter 134, and an antenna 136.

The signal provider 132 can be a component configured to prepare a signal for transmission such as by modulating or otherwise modifying a carrier signal in a manner reflective of desirably transmitted data. In some cases, the signal provider 132 is a pass through type, providing only a carrier signal.

The transmitter 134 may be configured to operate only as a radio signal emitter or, alternatively, may be a transducer configured to operate both as a radio signal emitter and receiver. Examples of suitable transmitters include a radio antenna circuit, an optical source, or a sonar transponder. The transmitter 134 may include an acoustic detector, an acoustic emitter, an optical sensor, an optical emitter, a thermal emitter, a thermal sensor, an electromagnetic wave sensor, and/or an electromagnetic wave emitter. An illustrative radio signal emitter for the transmitter 134 is a digital software radio providing UHF radio signals, although other radio types and frequencies may also be used.

The antenna 136 may be any suitable type of antenna, such as a monopole, dipole, fractal or other type of radiofrequency (RF) antenna and can be of any length with respect to a desirably sent or received carrier frequency. The antenna 136 is electrically connected to the transmitter 134 to send and/or receive communications signals. In some cases, the antenna 136 is additionally capable of GPS signal detection.

The power supply 140 may be a battery, for example. The power supply 140 is electrically connected to the controller 120 and the communications module 130 to provide power thereto.

The operational sensor 150 is used to acquire information that is to be transmitted to the remote unit 52 or from which information or data is to be derived and transmitted to the remote unit 52. According to some embodiments, the operational sensor 150 is adapted to sense a parameter of the buoy 100 itself, a parameter external to the buoy 100, or an exogenous signal. According to some embodiments, the sensor 150 is adapted to sense a parameter of the water W and/or a parameter of the air A. According to some embodiments, the sensor 150 includes an acoustic detector, an RF detector, a hydrophone, an optical detector, a camera, and/or an environmental sensor. Detected or transmitted signals may include, for example, radio, magnetic, electric, electromagnetic, mechanical, optical, and/or environmental signals. According to some embodiments, the sensor 150 includes a water parameter sensor and/or an air parameter sensor that detects or measures, with respect to the adjacent surrounding environment (i.e., the water W or the air A), at least one of conductivity, temperature, depth, turbidity, concentration or presence of chlorophyll, concentration or presence of dissolved oxygen, pH, and/or concentration or presence of selected or prescribed matter (which may be of organic, inorganic, chemical, radiological, or biological type, for example). In some embodiments, the sensor 150 includes at least one of: a compass; a GPS component; a velocimeter; and/or an accelerometer.

The local conditions sensor 152 is used to acquire information indicative of the conditions local to the buoy 100, which information is subsequently used to determine or predict when and how communication signals are to be transmitted from the communications module 130 to the remote receiver unit 52. The sensor 152 is adapted to detect one or more selected local parameters depending on the type of sensor.

According to some embodiments, the local conditions sensor 152 includes one or more of the following, depending on the local condition parameters to be detected: an acceleration sensor (e.g., an accelerometer); a velocity sensor (e.g., a velocimeter); an angle or tilt sensor; a range sensor (e.g., infrared range finder); a direction sensor (e.g., compass); a height sensor (e.g., inclined range sensor); a vertical position sensor (e.g., GPS receiver or integrating accelerometer); a light sensor (e.g., a photodetector); an acoustic sensor (e.g., electret microphone), a temperature sensor (e.g., thermistor); and a shape (image processing) sensor. One device for use as a shape detecting local conditions sensor 152 is a digital camera. Illustrative sensors for the local conditions sensor 152 include the ADXL330 chip sold by Analog Devices of Norwood, Mass., which can detect acceleration and tilt in three dimensions, the HMC 1043 chip sold by Honeywell International of Morristown, N.J., which can detect magnetic direction, and the ODA-6W photo detector sold by Opto-Diode Corp or Newbury Park, Calif.

While only a single local conditions sensor 152 is illustrated in FIG. 3, the communications buoy 100 may include two or more such local conditions sensors. The plurality of local conditions sensors 152 may be disposed at different locations about the buoy 100 and/or may be configured to detect different local parameters from one another.

Figure 5:
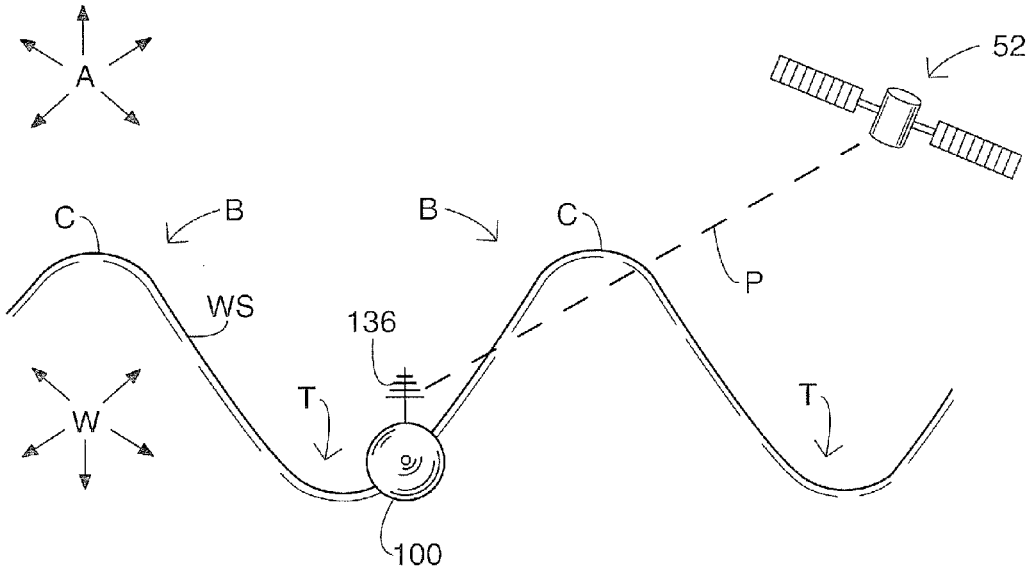
FIGS. 5-7 are schematic views of the communications buoy of FIG. 3 on a body of water and illustrating operations of the communications buoy.
Figure 6:
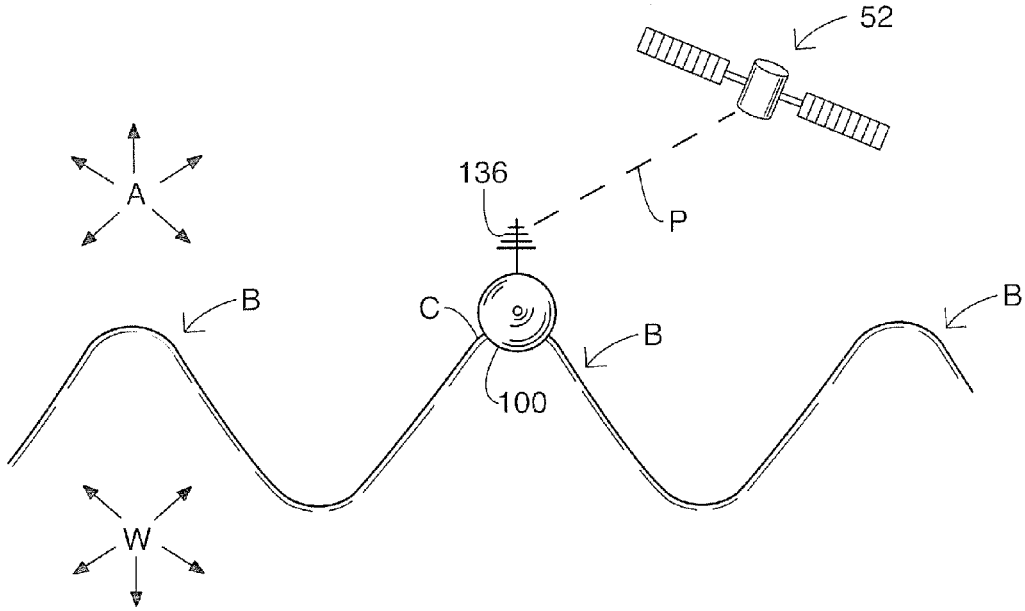
Figure 7:
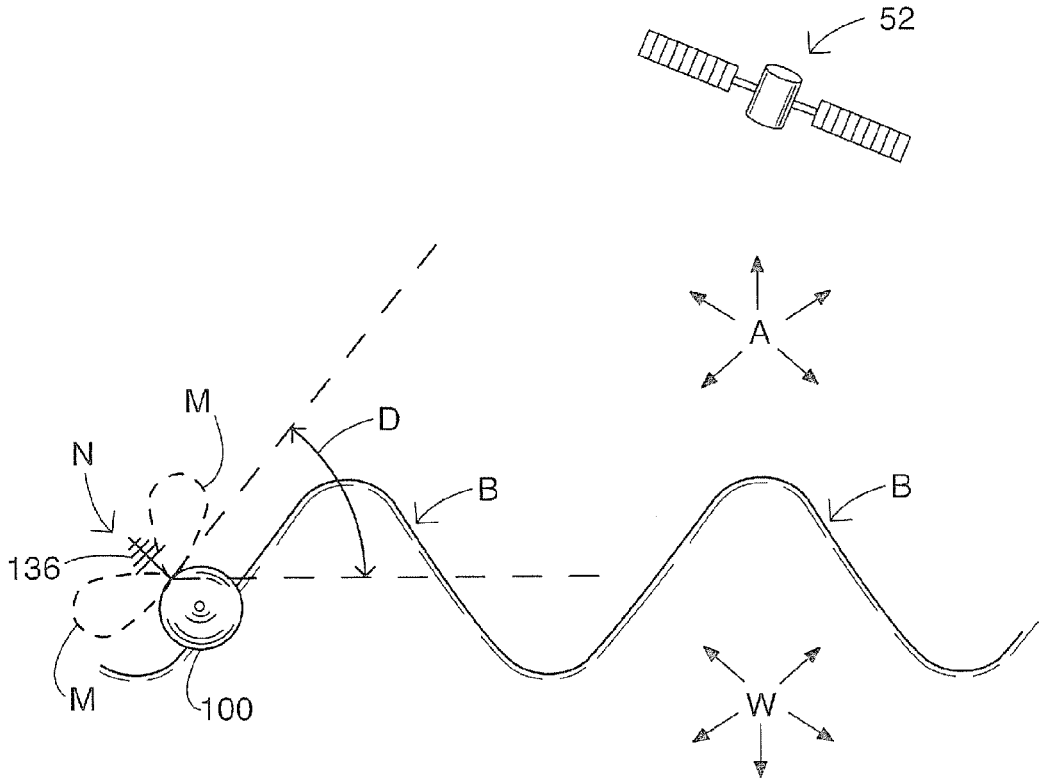

With reference to FIGS. 5-7, operations and methods of use of the communications buoy 100 in accordance with embodiments of the present invention will now be described. In use, the buoy 100 may be deployed as shown in FIG. 5 to float on the surface WS of a body of water W. It may be desirable or necessary from time to time or as often as feasible to communicate data from the buoy 100 to the remote receiver 52. However, waves B may splash water over ("over-wash") the buoy 100 or may rise up between the buoy 100 and the receiver 52. The waves B may thereby block an otherwise clear signal path P between the antenna 136 of the buoy 100 and the receiver 52 as illustrated in FIG. 5. This may occur even though the waves B do not fully engulf (e.g., fully submerge or over-wash) the buoy 100. For example, the buoy 100 may reside in a trough T between the crests C of adjacent waves B so that the transmission path P is blocked by a wave B. If an attempt is made to transmit radio signals along the transmission path P, it will be attenuated by the wave B. The attempt will not only be of no use or only limited use, it may serve to consume energy from the power supply 140. As such, the failed attempt may deplete the power supply 140 prematurely or sooner than desired or may necessitate that the power supply 140 be heavier or larger than otherwise required.

In order to advantageously address the foregoing concerns, the communications buoy 100 provides for radio communication during selected temporal periods that are windows of adequate transmission conditions (WATCs) with respect to local conditions. The communications buoy 100 may alter or regulate the radio communication during the WATC. Each WATC is delimited by a clear path time (CPT), which is defined as a time when a signal path P from the antenna 136 to the receiver 52 is determined or predicted by the buoy 100 to be substantially clear of obstructions (e.g., the wave B) as illustrated in FIG. 6, for example. The duration or temporal length of the clear path time may be referred to as the clear path duration (CPD). Each WATC may be further assessed with reference to, delimited by, or modified by a desirable tilt time (DTT), a sensor threshold value (STV) event and/or a local sea state representation. DTT is defined as a time when the orientation of the buoy 100 provides an antenna pattern of the antenna 136 that is oriented desirably (in direction and/or inclination) with respect to the receiver 52. STV event is defined as a sensor level of a local condition sensor 152 that exceeds a threshold indicating the signal path P is clear. Sea state representation is defined as a statistical representation of the height, length and/or slope of an adjacent wave B.

In use, the controller 120 receives a message that is to be forwarded to the remote receiver 52 over the transmission path P. The message may be received in any manner and from any source such as from the operational sensor 150, memory 126, a processor circuit and/or another device of the buoy 100. Using the local conditions sensor 152, the buoy 100 senses or detects environmental conditions local to the buoy 100 that may affect transmission. Local conditions data is generated (by the sensor 152 and/or the controller 120 using the data requisition module 128A; FIG. 4) and used by the controller 120 to programmatically determine and/or predict the clear transmission time during which communication signals have an adequately clear transmission path from the antenna 136 to the receiver 52 for successful transmission (e.g., using the predictor module 128B; FIG. 4). The controller 120 then programmatically adapts the transmission parameters to enhance communication between the buoy 100 and the receiver 52 (e.g., using the transmission control module 128C; FIG. 4). The controller 120 adaptively emits communication signals embodying the message in accordance with the adaptive transmission parameters for transmission over the transmission path P.

The step of determining and/or predicting the clear path time may include: determining the current existence of an actual or estimated clear path time; and/or predicting the occurrence of a future clear path time. Likewise, the desirable tilt time can be determined currently or predicted.

The process of determining or predicting may include comparing the local conditions data to one or more thresholds. For example, thresholding can include comparing the output of the local conditions sensor 152 or its first or second derivative to a threshold stored in memory.

The determination or prediction may be based directly on the local conditions data or the controller 120 may make the determination or prediction on the basis of data (e.g., quantities) or a representation (such as a sea state representation) derived from the local conditions data. Examples of derived quantities include time or frequency domain distributions. Other derived quantities may include predictions of time or probability of occurrence of a wave height or wave height class. Still other derived quantities may include prediction of buoy tilt or range of tilts. In some embodiments, the WATC and/or the CPT is determined by predictive filtering such as by Kalman or Bayesian method or filter or other suitable predictive method or filter.

The local conditions data employed by the controller 120 to make the determination or prediction of a clear transmission path may reflect a state of the buoy 100 such as an angle of inclination of the buoy 100 with respect to the horizon, the sun, or the remote receiver 52.

In some cases, a clear transmission time can be determined by measuring at least one of the height, position and range of a wave B, such as by reflective ultrasonic or optical methods including, but not limited to, shape detection or stereo ranging.

In some embodiments, an intervening or signal attenuating wave B (i.e., the wave blocking the transmission path P) is sensed directly. In some embodiments, the local conditions sensor 152 includes a digital camera that images the surrounding waves B. The output of the digital camera is suitably processed by the controller 120 to identify blocking waves B.

According to some embodiments, an intervening or signal attenuating wave B is sensed indirectly. In some embodiments, the controller 120 determines or predicts a clear path time based on a probability of obstruction inferred or derived from a sea state representation. The sea state representation may be expressed as or include estimates, data, a statistical representation and/or a model representing the frequency and/or temporal distribution of the size, period, wave length and/or slope of waves B proximate the buoy 100. In some cases, a sea state representation can be provided by other means, such as from data received from a satellite or stored in the memory 126.

According to some embodiments, the sensor 152 measures light intensity and the controller 120 determines a period and/or center time of direct sunlight. From this, the controller 120 determines the location of the top C of a wave B. In some embodiments, the controller 120 determines that when a photodetector sensor 152 is substantially continuously bathed in direct sunlight and the vertical inclination to the sun is less than that to the receiver 52, a clear transmission path P exists.

In some embodiments, the controller 120 determines or predicts the presence of a clear transmission path P by determining when the buoy 100 is proximate the top C of a wave B, referred to herein as a top center time. One method of determining the top center time includes detecting or predicting a time of sign reversal of the vertical component of a signal from an accelerometer serving as the local conditions sensor 152. In some cases, the top center time is estimated as the center time between wave troughs T using an optical sensor serving as the local conditions sensor 152 to measure variation in light intensity. In some embodiments, the top center time is determined by predictive filtering such as by use of a Kalman or Bayesian method or filter or other suitable predictive method or filter.

According to some embodiments, the local conditions data provided by the sensor 152 and used by the controller 120 to determine or predict the clear path time reflects an amount of sea spray or spume over the buoy 100.

According to some embodiments, the local conditions data provided by the sensor 152 and used by the controller 120 to determine or predict the clear path time reflects an amount of cloud cover over the buoy 100.

In some embodiments, the controller 120 predicts the clear path time by estimating at least one future period of WATC or CPT responsive to or corresponding to the wave heights or wave face slopes of waves B proximate the buoy 100. Wave height may be estimated by calculating vertical excursion of the buoy (e.g., from measurements of acceleration, tilt and/or time). One estimating method includes sampling sensor signals from the local condition sensor 152 during a sampling period to estimate vertical excursion of the buoy 100, or to derive a statistical representation of wave heights for that period and temporally proximate periods. In some embodiments, the representation is a sea state or derived quantities, such as mean wave height or significant wave height. The local condition sensor 152 may be an accelerometer, the signals from which represent time varying wave height. Low accelerometer signal levels can be used to determine a substantially calm sea and enable prediction of a substantially continuous WATC. In some cases, the controller 120 estimates inclination of one or more ocean waves and/or the height or vertical inclination to the receiver 52.

In use, the buoy 100 may be tilted by a wave passing under it as illustrated in FIG. 7. As a result, the antenna pattern M may be tipped at a tipping angle D away from the receiver 52, greatly reducing the likelihood of successful transmission. In other cases, the buoy 100 can be tilted towards the receiver 52 such that the antenna pattern null N is pointed at the receiver 52, thereby also reducing likelihood of transmission. To address this effect, the sensor 152 may detect and provide to the controller 120 local conditions data reflecting a direction or an angle of inclination of the buoy 100 with respect to the horizontal plane (i.e., with respect to the Earth's magnetic field), the sun, a navigation aiding device, or the remote receiver 52. Receiver direction can be determined in various ways, such as by determining and comparing the location of the buoy 100 provided by a GPS system and the location of the receiver 52 as stored in the memory 126 of the buoy 100. Inclination of the buoy 100 is defined as a vertical angle with respect to the receiver 52 or an obstruction such as a wave B. The desired tilt time (DTT) may be estimated by the controller 120 by comparing the inclination of the buoy 100 with respect to a wave B to inclination of the buoy 100 with respect to the receiver 52.

The controller 120 may adapt the transmission of the communication signals from the antenna 136 in any suitable manner. In some embodiments, the controller 120 adapts the transmission by setting the start and/or stop times (and thereby the duration) of the transmission in accordance with the period of time (i.e., CPT) when transmission is predicted to have enhanced probability of success (i.e., WATCs).

In some embodiments, the controller 120 adapts the transmission by selectively adjusting the transmit power of the transmission. The transmission power can be adjusted to provide a transmission that can be predictably completed during the WATC.

In some embodiments, the controller 120 adapts the transmission by selectively adjusting the data rate of the transmission. The data rate can be adjusted to provide a transmission that can be predictably completed during the WATC.

In some embodiments, the controller 120 adapts the transmission by selectively adjusting the repetition rate or count of the transmission. The repetition rate or count can be adjusted to provide transmission that can be predictably completed during the WATC.

In some embodiments, the controller 120 adapts the transmission by segmenting the message into a plurality of message segments and transmitting the message segments at spaced apart times during WATCs. The segments can be constructed and emitted to provide transmissions that can be predictably completed during each of the respective WATCs.

In some embodiments, the controller 120 (e.g., using the orientation control module 128D, FIG. 4) adapts the transmission by actively orienting the buoy 100 to provide transmission in a compass direction of a clear transmission path P. For example, the buoy may be actively oriented by transferring momentum from the buoy 100 to the water W or air A (e.g., using the orientation control mechanism 146; FIG. 3) to provide turning in a desired direction. The controller 120 may determine a magnetic heading and compare it to a heading stored in memory or a heading calculated from buoy location and receiver location as part of the procedure for turning in the desired direction.

On a substantially calm sea, such as indicated by low values of signal threshold value (STV) (e.g., from a tilt gauge or accelerometer serving as the local conditions sensor 152), the buoy 100 may have a WATC that is substantially continuous. In this case, the controller 120 may determine that transmission is permitted with a clear transmission path at any time or duration until changing signals from the local condition sensor 152 indicate an increased chance of signal interruption. In this case, the controller 120 may adapt the transmission accordingly.

Advantageously, the buoy 100 can enhance the energy efficiency of communications by transmitting signals at times a clear signal path is determined. Moreover, the buoy 100 can maintain reliable communications while supporting reduced battery weight by adjusting transmission according to local conditions.

As discussed above, the buoy 100 is adapted to float on the surface of the water. According to some embodiments, the buoy 100 is deployed from an underwater location and floats to the water surface. From the floating location, the buoy 100 sends and/or receives wireless communications signals to/from a remote device. The buoy 100 may communicate with the remote device using electromagnetic, electrical, magnetic, optical, and/or acoustic signals. The buoy 100 may also communicate (e.g., acoustically, optically, or magnetic inductively) with a remote device from an underwater location.

The communications between the buoy 100 and the remote receiver device 52 may be one-way or two-way. For example, according to some embodiments, the buoy 100 receives signals from an underwater device such as the submarine and forwards these signals to a device outside of the water such as the remote apparatus receiver 52. Alternatively or additionally, the buoy 100 receives signals from a device outside of the water such as the remote apparatus 52 and forwards these signals to an underwater device such as the submarine 54. In some such embodiments, the communications between the buoy 100 and the remote underwater device are accomplished via acoustic signals and the communications between the buoy 100 and the remote device outside the water are accomplished via RF signals. By way of example, the buoy 100 may receive a communication (e.g., via acoustic transmission) from a node in the SeaWeb sonar communications system developed by SPAWAR, US Navy, in San Diego, Calif., and forward the communication to a remote receiver (e.g., via radio transmission).

According to some embodiments, the buoy 100 rises to the surface of the water to obtain information or data that may include: geo-location coordinates, command and control signals, and/or mission updates, and communicates such data to an underwater device such as a monitoring station or vehicle (e.g., the submarine 40). In some embodiments, the buoy 100 wirelessly communicates such information to the submerged device.

In some embodiments, the buoy 100 sends signals to the remote device including at least one of: a signal detected from another source; a signal from another source that has been processed by the buoy 100; information related to the operation or status of the buoy 100 itself; an environmental parameter sensed by the buoy 100; a forwarded message from another source; an identifier of the buoy 100; the current time; the current date; and the location of the buoy 100. The buoy 100 may transmit a message containing at least one of: an identifier of the buoy 100; the time a signal or parameter was detected by the buoy 100; a location; a raw signal; a signature; a classification; identification; and an estimate of a range or direction to a source of a signal.

According to some embodiments, the buoy 100 is conveyed by a vehicle (e.g., the submarine 54) and released or dispensed therefrom. According to some embodiments, the buoy 100 is released or dispensed from a sensing system or a moored platform. The buoy 100 may be released by a swimmer.

According to some embodiments, the buoy 100 senses an environmental parameter and/or communicates with a remote device while the buoy 100 is floating submerged in the water, proximate the water surface, or above the water surface.

In some cases, the buoy 100 is released to float to the surface and emit at least one of: an acoustic, optical, or electromagnetic signal. In some embodiments, the buoy 100 is interrogated or commanded by another device to emit a communications signal.

In some cases, the buoy 100 operates in response to a prescribed lapse of time or arrival of a prescribed time. For example, the buoy 100 may begin emitting communications signals or "wake up" to receive communications signals at a pre-programmed time. In some cases, the buoy 100 operates in response to a detected signal (e.g., an interrogation or command signal).

In some cases, the buoy 100 operates in response to a detected event such as a received signal or an environmental event. In an illustrative use, the buoy 100 acoustically detects a passing vessel, for example, by detecting an engine noise from the vessel. According to some embodiments, the buoy 100 sends notification of the detected vessel to a remote receiver. In some cases, the notification includes additional data such as an identifier of the buoy 100, a signal classification, the location where the detection occurred, and/or the time of the detection. Other environmental events that may trigger the buoy 100 to communicate may include, for example, seismic activity, a tsunami, a storm, or any other event detectable by the buoy 100.

According to some embodiments, the buoy 100 while submerged senses an environmental parameter (e.g., a parameter of the water) and thereafter floats to the water surface or into the air to communicate the sensed data to a remote device.

While the buoy 100 has been described herein as a radio buoy (i.e., an emitter device configured to emit radio signals to a remote receiver unit), according to some embodiments other types of signal emission, such as optical or sonar, may be enabled and employed. Examples of suitable transmitters include an acoustic emitter, an optical source emitter or a sonar transponder. The transmitter may also include an acoustic detector, an optical sensor, or an electromagnetic wave sensor.

In some embodiments, the buoy 100 is used for locating, rescuing and/or retrieving. For example, the buoy 100 may include a light that blinks or illuminates adaptively in accordance with the determined and/or predicted clear transmission times as discussed above (e.g., the light only blinks when it can be seen). Such light blinking may be used to send a message.

In some cases, controller 120 can comprise a component for scuttling (i.e., destroying or breaching) at least one of the controller 120, memory 126, the transmitter 134 and the buoy 100.

While the buoy 100 as described herein is an aquatic buoy, aspects of the present invention may be applied to communications devices of other types such as land-based devices, aerial devices (e.g., units floating in air) or vehicles that transmit a communication signal of any type that may from time to time be at least partly blocked by water, ground terrain or aerial obstructions (e.g., clouds). Such devices can additionally detect signals (e.g., for exfiltration or for forwarding).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A method for selectively transmitting communication signals from a communications buoy to a remote receiver, the communications buoy including a sensor and an emitter device, the method comprising:

detecting conditions local to the communications buoy using the sensor;

generating local conditions data corresponding to the local conditions detected by the sensor;

using the local conditions data, determining and/or predicting a clear transmission time during which communication signals from the emitter device have an adequately clear transmission path to the remote receiver for successful transmission of communication signals from the emitter device to the remote receiver; and adaptively transmitting communication signals from the emitter device to the remote receiver as a function of the determined and/or predicted clear transmission time;

wherein generating the local conditions data includes deriving the local conditions data from sensor signals generated by the sensor, the sensor signals corresponding to the conditions local to the emitter device.

2. The method of claim 1 wherein:

the communications buoy is a floating aquatic communications buoy including a radio transmitter;

the emitter device is a radio antenna; and the method includes generating radio signals from the radio transmitter to the remote receiver during one or more clear transmission times while the communications buoy is floating on a body of water.

3. The method of claim 1 wherein the sensor signals are reflective of the location of the communications buoy with respect to water waves between the communications buoy and the remote receiver.

4. The method of claim 1 wherein determining and/or predicting the clear transmission time includes predicting one or more future clear transmission times using the local conditions data.

5. The method of claim 4 wherein predicting one or more future clear transmission times includes programmatically analyzing the local conditions data using a predictive filter.

6. The method of claim 4 wherein predicting one or more future clear transmission times includes predicting the one or more future clear transmission times using at least one sensor signal representative of: an acceleration of the communications buoy; a velocity of the communications buoy; a position of the communications buoy; a tilt of the communications buoy; a directional orientation of the communications buoy; and intensity of signals received by the communications buoy.

7. The method of claim 4 wherein predicting one or more future clear transmission times includes estimating a position of the communications buoy relative to the height of at least one aquatic wave with respect to a transmission path from the communications buoy to the remote receiver.

8. The method of claim 1 wherein determining and/or predicting the clear transmission time includes generating a statistical representation of one or more sea state attributes of a body of water upon which the communications buoy is floating.

9. The method of claim 1 wherein:

generating local conditions data corresponding to the local conditions detected by the sensor includes generating position data corresponding to an elevation of the communications buoy and/or an orientation of the communications buoy with respect to the horizon;

determining and/or predicting the clear transmission time includes using the position data to predict when the emitter device will be desirably positioned and/or oriented with respect to the remote receiver; and adaptively transmitting communication signals from the emitter device to the remote receiver includes determining when to generate signals from the emitter device to the remote receiver based on the prediction.

10. The method of claim 1 wherein determining and/or predicting the clear transmission time includes comparing the local conditions data to a threshold.

11. The method of claim 1 wherein the local conditions data corresponds to an intensity of light incident upon the emitter device.

12. The method of claim 1 wherein detecting conditions local to the communications buoy using the sensor includes imaging surrounding aquatic waves using a camera forming a part of the communications buoy.

13. The method of claim 1 wherein adaptively transmitting communication signals includes selectively controlling the start and termination of transmission of the communications signals from the emitter device to the remote receiver as a function of the determined and/or predicted clear transmission time.

14. The method of claim 1 wherein adaptively transmitting communication signals includes selectively controlling a transmission power level of the communications signals transmitted from the emitter device to the remote receiver as a function of the determined and/or predicted clear transmission time.

15. The method of claim 1 wherein adaptively transmitting communication signals includes selectively controlling a data transmission rate of the communications signals transmitted from the emitter device to the remote receiver as a function of the determined and/or predicted clear transmission time.

16. The method of claim 1 wherein adaptively transmitting communication signals includes actively orienting the emitting device to selectively control a compass direction of transmission of the communication signals as a function of the determined and/or predicted clear transmission time.

17. The method of claim 1 wherein adaptively transmitting communication signals includes segmenting a message into a plurality of message segments and transmitting the respective message segments at temporally spaced apart times determined and/or predicted by the communications buoy to be clear transmission times.

18. A communications buoy for selectively transmitting communication signals to a remote receiver, the communications buoy comprising:

an emitter device to transmit communication signals to the remote receiver;

a sensor to detect conditions local to the communications buoy using the sensor;

a controller configured to:

generate local conditions data corresponding to the local conditions detected by the sensor, including deriving the local conditions data from sensor signals generated by the sensor, the sensor signals corresponding to the conditions local to the emitter device;

determine and/or predict, using the local conditions data, a clear transmission time during which communication signals from the emitter device have an adequately clear transmission path to the remote receiver for successful transmission of communication signals from the emitter device to the remote receiver; and adaptively transmit communication signals from the emitter device to the remote receiver as a function of the determined and/or predicted clear transmission time.

* * * * *